US006036548A

United States Patent [19]

Braithwaite

[11] Patent Number: 6,036,548

[45] Date of Patent: Mar. 14, 2000

[54] DOUBLE SLOT EDGE CARD CONNECTOR

[75] Inventor: Jim Braithwaite, Scotland, United Kingdom

[73] Assignee: The Whitaker Corporation, Wilmingston, Del.

[21] Appl. No.: 09/111,022

[22] Filed: Jul. 7, 1998

Related U.S. Application Data

[60] Provisional application No. 60/053,181, Jul. 18, 1999.

[51] Int. Cl.[7] ..... H01R 23/70

[52] U.S. Cl. ..... 439/637

[58] Field of Search ..... 439/637, 631, 439/61

[56] References Cited

U.S. PATENT DOCUMENTS

| | | | |
|---|---|---|---|
| 3,858,961 | 1/1975 | Goodman et al. | 339/176 MP |
| 4,220,382 | 9/1980 | Ritchie et al. | 339/17 LM |
| 4,575,175 | 3/1986 | Wilson | 339/176 MP |
| 4,795,374 | 1/1989 | Rishworth et al. | 439/634 |
| 5,013,264 | 5/1991 | Tondreault | 439/636 |
| 5,061,190 | 10/1991 | Medeiors et al. | 439/60 |
| 5,192,220 | 3/1993 | Billman et al. | 439/327 |
| 5,443,394 | 8/1995 | Billman et al. | 439/157 |
| 5,816,831 | 10/1998 | Clark | 439/79 |
| 5,830,017 | 11/1998 | Owslet et al. | 439/637 |

*Primary Examiner*—Michael L. Gellner
*Assistant Examiner*—Briggitte R. Hammond

[57] ABSTRACT

A connector (2) has a first card receiving slot (16) and a second card receiving slot (32). The first card receiving slot is for connection to a circuit board with the ISA standard, and the second slot is for connection to a circuit board with the PCI standard. The terminals (24, 38) and terminal receiving cavities (28, 36) of the first and second slots are offset (P3) with respect to each other such that the cavities interleave in a central portion (60) of the housing between the slots. The latter enables provision of a small spacing D between the slots (16, 32).

7 Claims, 6 Drawing Sheets

DOUBLE SLOT EDGE CARD CONNECTOR

This Application claims the benefit of U.S. Provisional Application Ser. No. 60/053,181, filed Jul. 18, 1999.

BACKGROUND OF THE INVENTION

1. Field of the Invention

This invention relates to a connector having two slots for receiving edges of circuit cards, for connection thereto.

2. Description of the Prior Art

In the computer industry, there are different standards for connection of additional printed circuits boards to the mother board of a computer. For example there is the PCI standard whereby contacts are separated at a pitch of 0.05 inches, and there is the ISA standard whereby contacts are separated by a pitch of 0.1 inches. In many computers, it is typical to provide connectors for each standard such that expansion modules (such as video cards, sound cards etc.) with either standard may be connected to the mother board. Only one of these standards will be used at a time. The provision of additional connectors not only consumes space on the mother board, but also increases handling, assembly and manufacturing costs.

SUMMARY OF THE INVENTION

It is an object of this invention to provide an improved connector system that enables connection of boards with different standards, but that is cost effective and that utilises minimum space.

Objects of this invention have been achieved by providing the connector assembly according to claim 1. Disclosed herein is a connector comprising an insulative housing and a plurality of electrical terminals mounted in cavities of the housing, the housing comprising a pair of card receiving slots extending parallel to each other in a longitudinal direction, the slots extending from a card receiving face into the housing and intersecting the terminal receiving cavities such that contact portions of the terminals bias from the cavities into the slots for contacting a circuit board arranged in the respective card receiving slot, wherein cavities of the first connector portion interleave cavities of the second connector portion in a central section of the housing arranged between the card receiving slots. This allows a particularly compact spacing between card receiving slots. As the connectors are not in use simultaneously, the cavities may intersect each other for a particularly compact arrangement of cavities and terminals.

Further advantageous aspects of this invention will be described in the claims or will be apparent from the following description and drawings.

BRIEF DESCRIPTION OF THE DRAWINGS

FIG. 3 is an isometric view of the housing towards a mounting face;

DETAILED DESCRIPTION OF THE INVENTION

Figure 6:
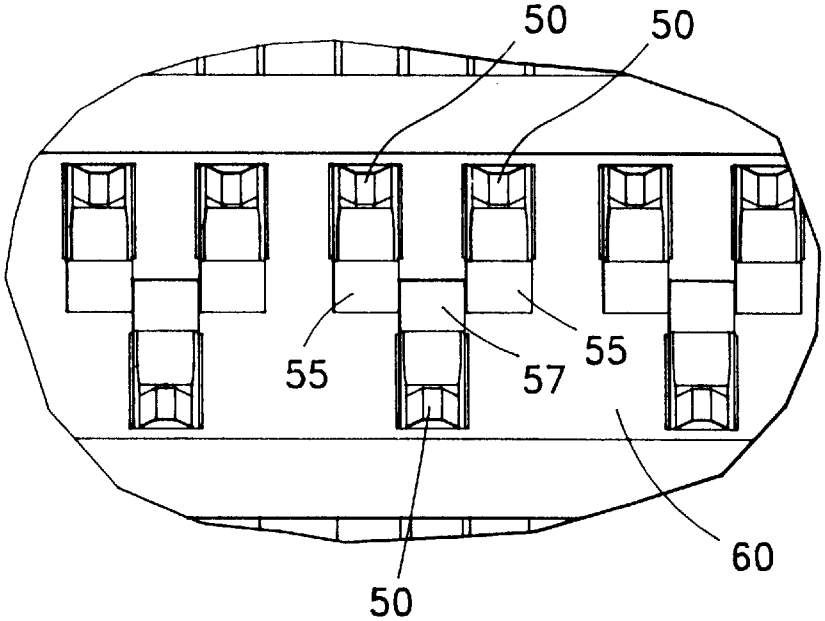
FIG. 6 is a detailed plan view of part of the mating face of the connector, in particular a partial detailed view of the mating face of FIG. 1.
Figure 1:
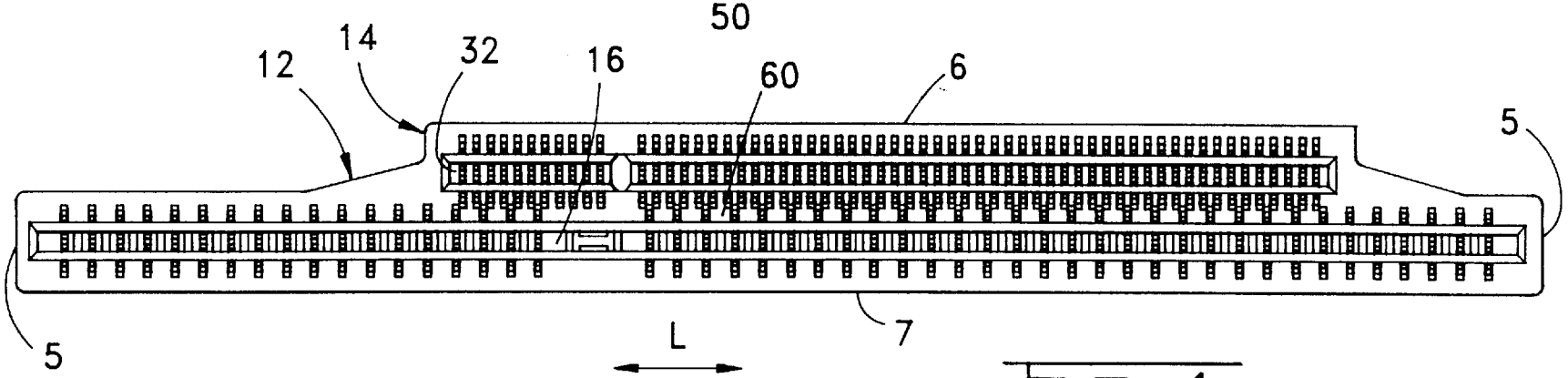
FIG. 1 is a plan view towards a mating face of a connector according to this invention.
Figure 2:
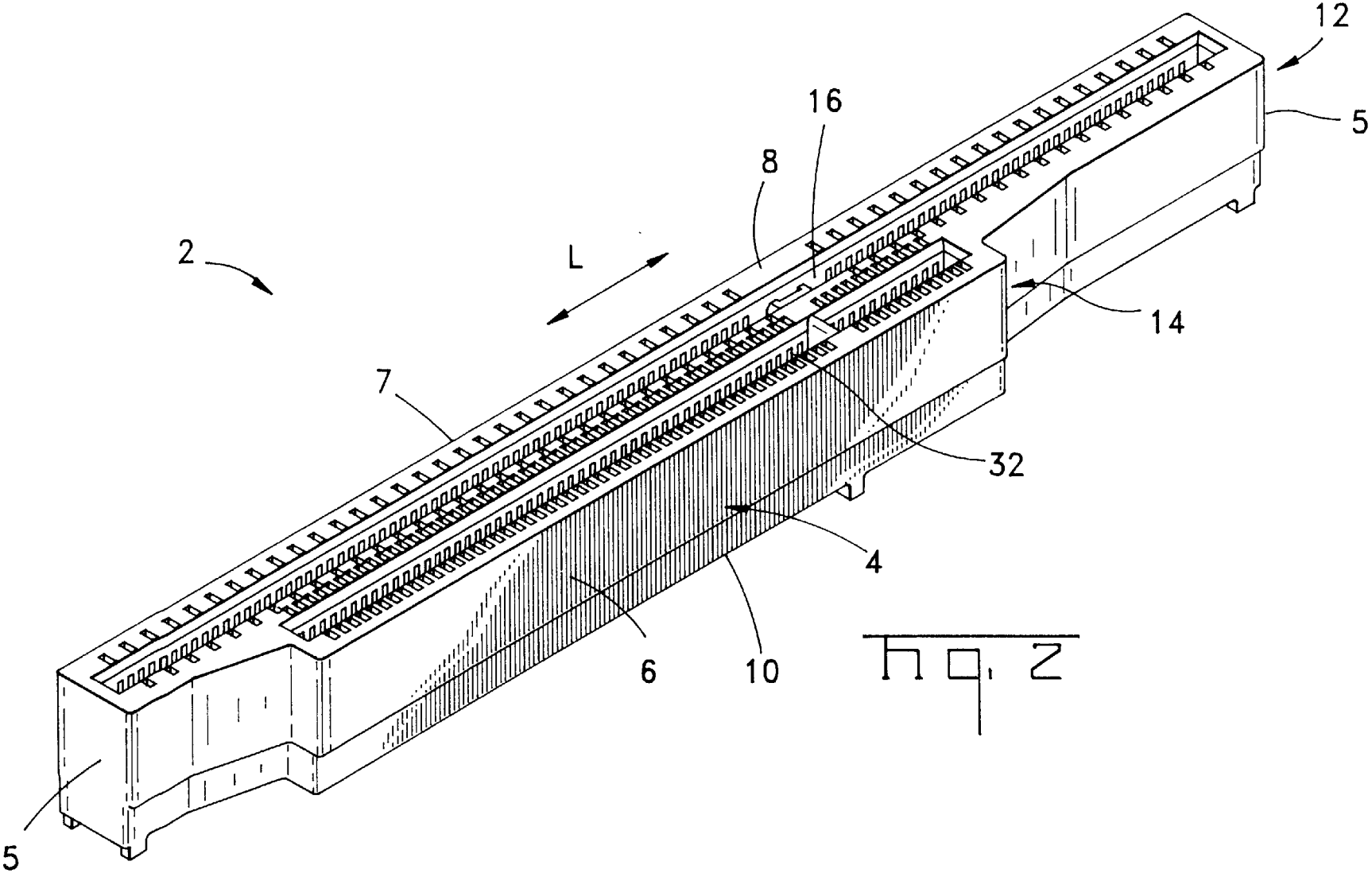
FIG. 2 is an isometric view, showing the mating face, of a connector housing of the connector.
Figure 7:
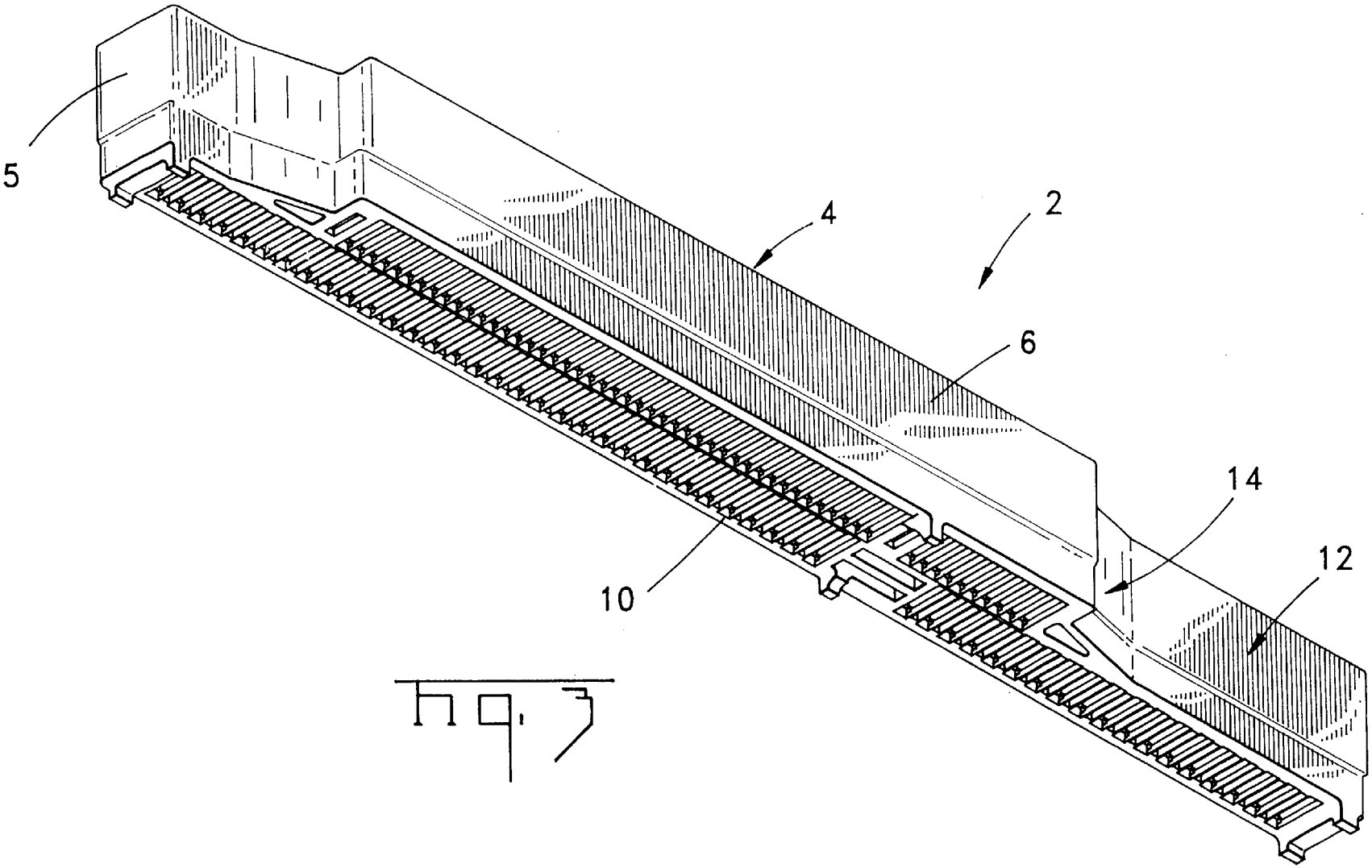
FIG. 7 is a plan view of the connector towards a mounting face.
Figure 4:
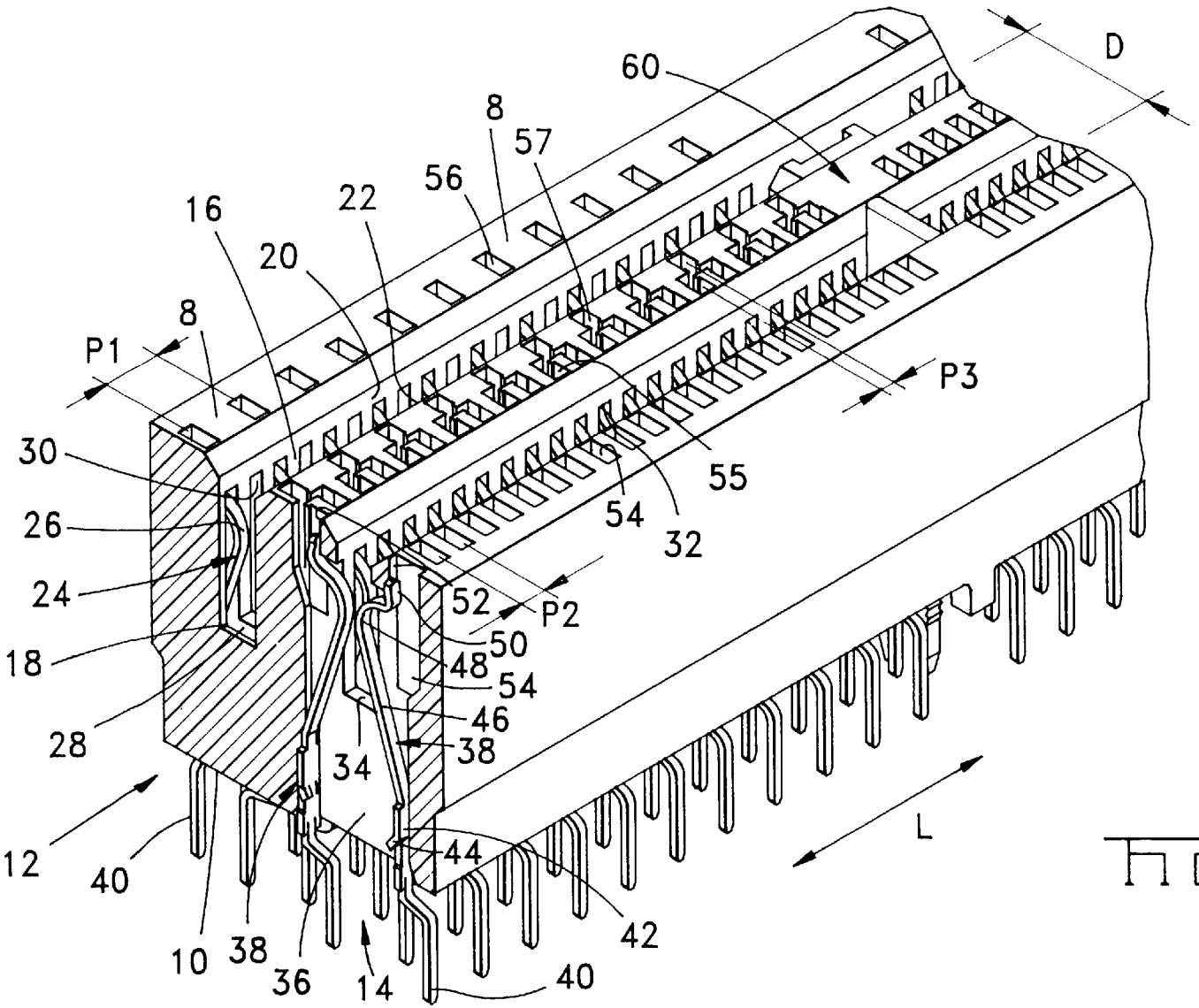
FIG. 4 is a partial cross-sectional isometric view of the connector according to this invention.
Figure 5:
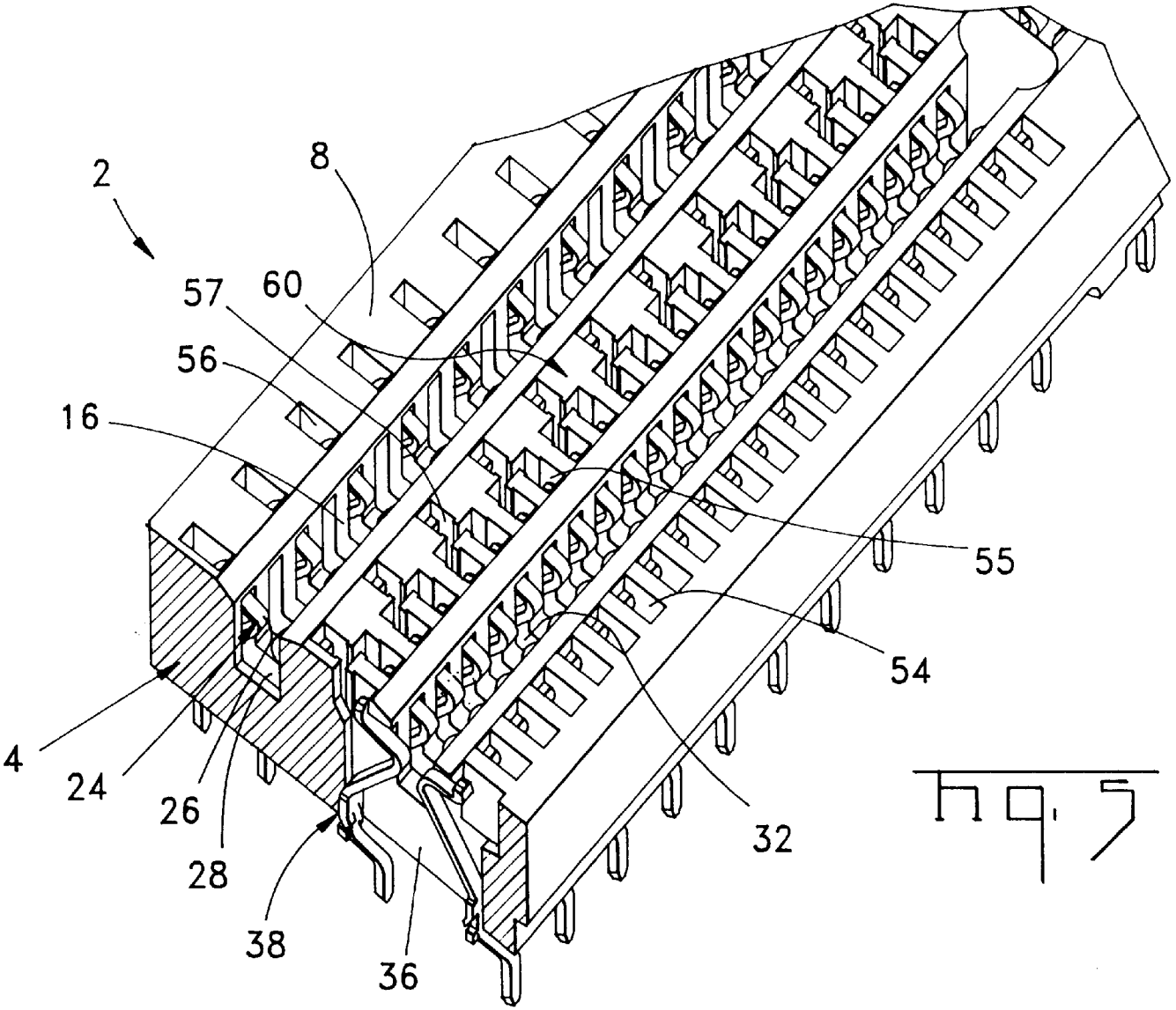
FIG. 5 is a further isometric view similar to FIG. 4 but taken at a different angle.
Figure 8:
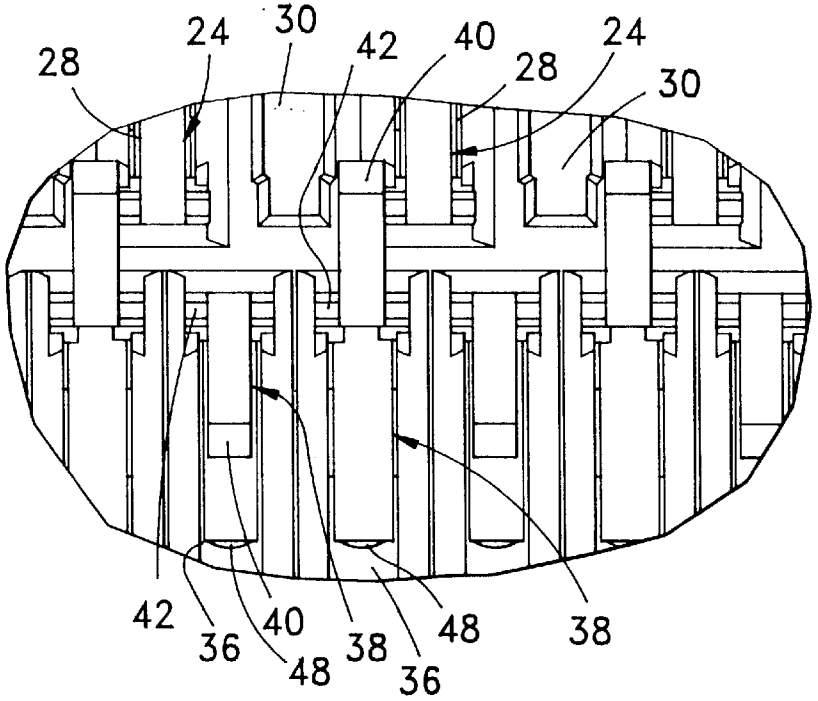
FIG. 8 is a partial detailed view of a central portion of the mating face of the connector.
Figure 7:
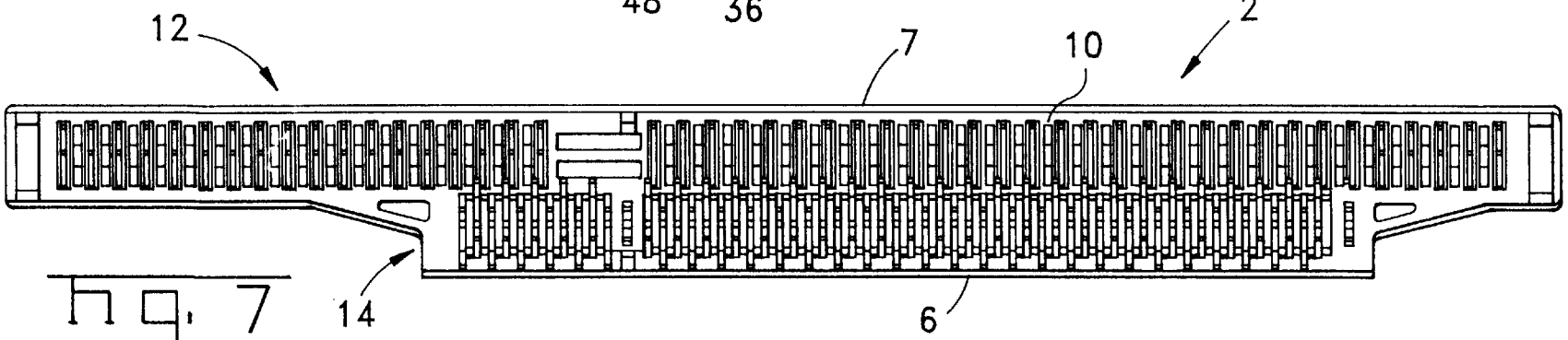

Referring to all the figures, but mainly FIGS. 2 and 4, a connector 2 comprises an insulative housing 4 extending in an longitudinal direction L between end walls 5, further comprising opposed side walls 6, 7 and opposed mating and mounting faces 8, 10 respectively. The connector comprises a first connector section 12 and a second connector section 14. The first connector section comprises a card receiving slot 16 extending in the longitudinal direction, the card receiving slot accessible from the mating face 8 and extending into the housing towards the mounting face 10, to a slot bottom face 18 which is roughly centrally positioned between the mating and mounting faces 8, 10 respectively.

The card receiving slot 16 is bounded by opposed outer and inner sides 20, 22 that are separated by a distance slightly greater than the thickness of a card, such as a printed circuit board, for insertion in the slot 16. The first connector portion 12, further comprises two rows of terminals 24, a first row extending alongside the outer side 20 of the slot 16 and a second row extending along the inner side 22 of the slot 16, the first and second rows of terminals 24 having arcuate contact protrusions 26 protecting into the slots 16 for biasing against contact pads of a circuit board received in the slot. The contact protrusions 26 of the first and second rows are arranged in opposed mirror image symmetry. Each pair of opposed terminals 24, is mounted in a respective terminal receiving cavity 28 of the housing 4, whereby adjacent terminal receiving cavities are spaced at a pitch P1. Further cavities 30 are positioned between the terminal receiving cavities 28 and are for reducing the material usage and weight of the connector.

The second connector portion 14 also comprises a card receiving slot 32 that extends in the longitudinal direction L parallel to the first slot 16, the slot extending from the mating face 8 into the housing 4 towards the mounting face 10, to a slot bottom face 34 substantially centrally positioned between the mating and mounting faces 8, 10. The second connector section 14 similarly comprises a plurality of juxtaposed terminal receiving cavities 36 within which are mounted pairs f opposed terminals 38, the terminals thus arranged in two substantially opposed rows.

The terminals 38 are of a similar design to the terminals 24, each comprising a connection section 40 in the form of a pin for insertion into a contacting hole of a printed circuit board or the like, a mounting portion 42 having barbs 44 for securely lodging the terminals within the housing 4, a spring arm 46, a contact portion 48 in the form of an arcuate contact protrusion, and a free end 50. The terminals are stamped and formed from sheet metal and stitched into the housing 4 from the mounting face 10, whereby the barbs 40 dig into the housing and securely retain the terminals therein. The mounting portions 42 of the terminals are of a slightly greater width (seen in the longitudinal direction) than the contact portions 48, and are held within slots that are slightly wider (in the longitudinal direction L) than the major portion of the terminal receiving cavities 36, 28. A secure and stable support of the terminals in the housing is thus provided.

The terminal free ends 50 are arranged towards the mating face 8 and are arranged adjacent shoulders 52 that limit biasing of the contact portions 48 into the card receiving slots 16, 32, whereby the shoulders 52 are formed by the provision of cavities 54, 55, 56, 57 that extend from the mating face 8 into the housing towards the mounting face 10. The cavities 54, 55, 56, 57 are arranged at a small distance from the respective card receiving slots 16, 32. The cavities 54, 55 form part of the terminal receiving cavities 36, and the cavities 56, 57 form part of the terminal receiving cavities 28.

As best seen in FIG. 4, the terminal receiving cavities 36 of the second connector section 14 are spaced apart from each other at a pitch P2 that is less than the pitch P1 of the first connector section 12. In this embodiment, the pitch P2 is half of the distance of P1, for example P2 is 0.5 inches which corresponds to the PCI standard, and P1 is 0.1 inches which corresponds to the ISA standard for connection of printed circuit boards. In many applications it is desirable to be able to connect optional boards with different standards, such that the user has greater flexibility. Only one board will be connected into the connector 2 at a time, depending on the standard used.

In order to reduce the distance D between the two card receiving slots 16, 32, the terminal receiving cavities 36 of the second connector section 14 are offset with respect to the terminal receiving cavities 24 of the first connector section 12, such that the cavities and terminals of the first and second connector section can be provided in an interleaving manner. The latter is best seen by observing the interleaving cavities 55, 57 in a central portion 60 of housing that is positioned between the card receiving slot 16, 32. The cavities 55, 57 form an upper portion of the terminal receiving cavities 28, 36 respectively, intersect each other such that the cavities 57 of the first connector section 12 communicate with cavities 54 of the second connector section 14 in the housing central portion 60. The risk of electrical contact between terminals of the first connector section and of the second connector section is of not concern because only one or the other card receiving slot will receive a circuit board at a time. The interleaving of the terminal receiving cavities 28, 36 however allows a particularly compact spacing D between card receiving slots 16, 32 whilst enabling provision of terminals 24, 38 with good spring properties and sufficient flexibility for reliable and defined contact force against circuit pads of a printed circuit board. As best seen in FIG. 4, the terminals and cavities of the first and second connector sections are offset in the longitudinal direction L by a pitch P3 which is half the distance P2.

I claim:

1. A connector comprising an insulative housing and a plurality of electrical terminals mounted respectively in terminal receiving cavities of a first connector portion of the housing and in terminal receiving cavities of a second portion of the housing, said first and second connector portions of said housing extending parallel to each other in a longitudinal direction and separated by a central portion of the housing, the housing comprising first and second card receiving slots extending parallel to each other in said in longitudinal direction and separated by said central portion of the housing, each slot extending from a mating face into the housing and intersecting respective said terminal receiving cavities in said first and second connector portions of said housing corresponding thereto, such that contact portions of respective said terminals bias from the terminal receiving cavities into the corresponding slot for contacting a circuit board arranged therein, wherein the cavities of the first connector portion interleave the cavities of the second connector portion and the central portion of the housing.

2. The connector of claim 1 wherein said terminals of each connector portion are arranged in a pair of rows, such that said contact portions of the terminals are arranged substantially in mirror image symmetry on opposed sides of respective said slots.

3. The connector of claim 1 wherein adjacent said cavities of the first connector portion are spaced at a pitch P1, and adjacent said cavities of the second connector portion are spaced at a pitch P2 different from the pitch P1 of the first connector portion.

4. The connector of claim 3 wherein the pitch P1 of the first connector portion is double the pitch P2 of the second connector portion.

5. The connector of claim 4 wherein said cavities of the second connector portion are offset with respect to said cavities of the first connector portion in the longitudinal direction, the cavities being offset by a spacing P3 which is half the pitch P2 of the second connector portion.

6. The connector of claim 1 wherein the terminal receiving cavities of the first connector portion intersect certain said terminal receiving cavities of the second connector portion in the central portion of the housing.

7. The connector of claim 6 wherein said cavities of the first connector portion intersect said cavities of the second connector portion proximate the mating face of the housing.

* * * * *